US012497205B1

(12) United States Patent
Awad

(10) Patent No.: US 12,497,205 B1
(45) Date of Patent: Dec. 16, 2025

(54) SLAT FILLER AND THE METHOD OF USING THEREOF

(71) Applicant: Amgad Awad, Parlin, NJ (US)

(72) Inventor: Amgad Awad, Parlin, NJ (US)

( * ) Notice: Subject to any disclaimer, the term of this patent is extended or adjusted under 35 U.S.C. 154(b) by 0 days.

(21) Appl. No.: 18/747,344

(22) Filed: Jun. 18, 2024

(51) Int. Cl.
*B65B 5/10* (2006.01)
*B65B 1/06* (2006.01)
*B65B 39/00* (2006.01)
*B65B 57/14* (2006.01)

(52) U.S. Cl.
CPC ..... *B65B 57/145* (2013.01); *B65B 1/06* (2013.01); *B65B 39/007* (2013.01); *B65B 2039/009* (2013.01)

(58) Field of Classification Search
CPC . B65B 5/103; B65B 2039/009; B65B 39/007; B65B 39/145; B65B 1/06
See application file for complete search history.

(56) References Cited

U.S. PATENT DOCUMENTS 3,139,713 A * 7/1964 071964 ..... B65B 5/103 53/64
3,354,607 A * 11/1967 Lakso ..... B65B 57/20 53/167
3,925,960 A * 12/1975 Saari ..... B65B 37/005 53/167
4,408,295 A * 10/1983 Kavage ..... B07C 5/3404 53/494
4,674,259 A * 6/1987 Hills ..... B65B 39/007 53/247
4,680,464 A * 7/1987 Bross ..... G06M 7/02 53/57
6,378,572 B1 * 4/2002 Neubauer ..... G06V 20/66 53/493
7,795,556 B1 * 9/2010 Dean ..... B07C 5/3422 53/244
8,146,331 B2 * 4/2012 Soloman ..... B65B 57/18 53/151

FOREIGN PATENT DOCUMENTS

WO WO-2017132992 A1 * 8/2017 ..... B65B 57/20

* cited by examiner

*Primary Examiner* — Andrew M Tecco
(74) *Attorney, Agent, or Firm* — Changi Wu. Esq.; Changi Wu Law Office

(57) ABSTRACT

An automated slat filling system for dispensing a plurality of articles to a plurality of containers without rejecting one or more of the plurality of containers comprises: (a) a plurality of slats; (b) a plurality of cavities formed on the plurality of the slats; (c) a conveyance device; (d) an intelligent control device; (e) a vision inspection device; (f) a rejection repository, and (g) a diverting device, and the method of use thereof.

12 Claims, 8 Drawing Sheets

SLAT FILLER AND THE METHOD OF USING THEREOF

CROSS-REFERENCE RELATED TO RELATED APPLICATIONS

None.

BACKGROUND

In a production line, the process of filling a container with articles, such as tablets or capsules, is normally done by an automated process with an automated slat filler system. The slat filler system's main purpose is to fill bottles with tablets or capsules. It accomplishes this by utilizing a hopper filled with tablets in the back of the machine. A set of slats is then conveyed around underneath the hopper, where the tablets would fill in the slats. As the slats move around to the front of the machine, a vision system is used to inspect the tablets in the slats for presence and quality. The result of the slats is then tracked, and the good and bad slats are allowed to be dispensed into the bottles. The good bottles are allowed to exit the machine and processed downstream to the next machine. However, the bad bottles are tracked and rejected for rework. The issue of the current slat filler system is that the containers are filled, regardless of whether the quality or quantity of the tablets in each of the containers meets the required quality or quantity, and then is to be rejected after the tables on the slats are filled to the containers. Therefore, time and cost are wasted in the filling of containers that would be rejected later. Also, there would be a need for additional devices to expunge the containers with inferior tablets, which adds costs and complexity to the filling process.

BRIEF SUMMARY OF THE INVENTION

This brief summary is included so as to introduce, in an abbreviated form, various topics to be elaborated upon below in the Detailed Description. This Brief Summary is not intended to identify key or essential aspects of the claimed invention. This brief summary is similarly not intended to aid in determining the scope of the claims. The subject matters of this application overcome the aforementioned problems and are directed to an automated slat filling system for dispensing a plurality of articles, comprising a plurality of slats, a conveyance device, wherein the conveyance device is configured to move the plurality of slats; an intelligent control device, a vision inspection device, a rejection repository; and a diverting device; and the method of using the automated slat filling system.

BRIEF DESCRIPTION OF THE DRAWINGS

It should be understood that the drawings are merely representative, are not necessarily drawn to scale, and are not intended to limit the subject matter of this application.

DETAILED DESCRIPTION

Figure 1:
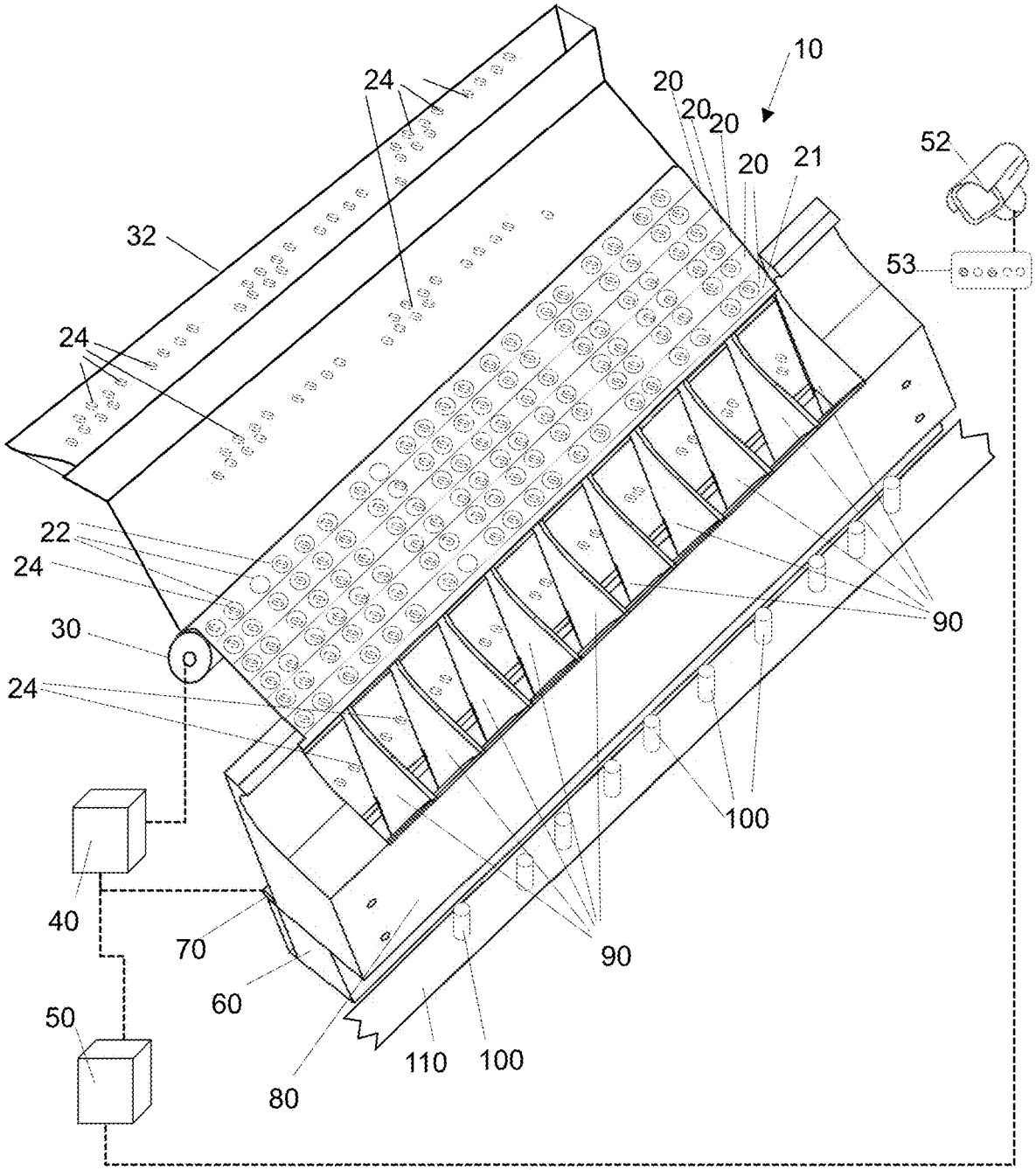
FIG. 1 is a perspective view of one embodiment of the invention.
Figure 2:
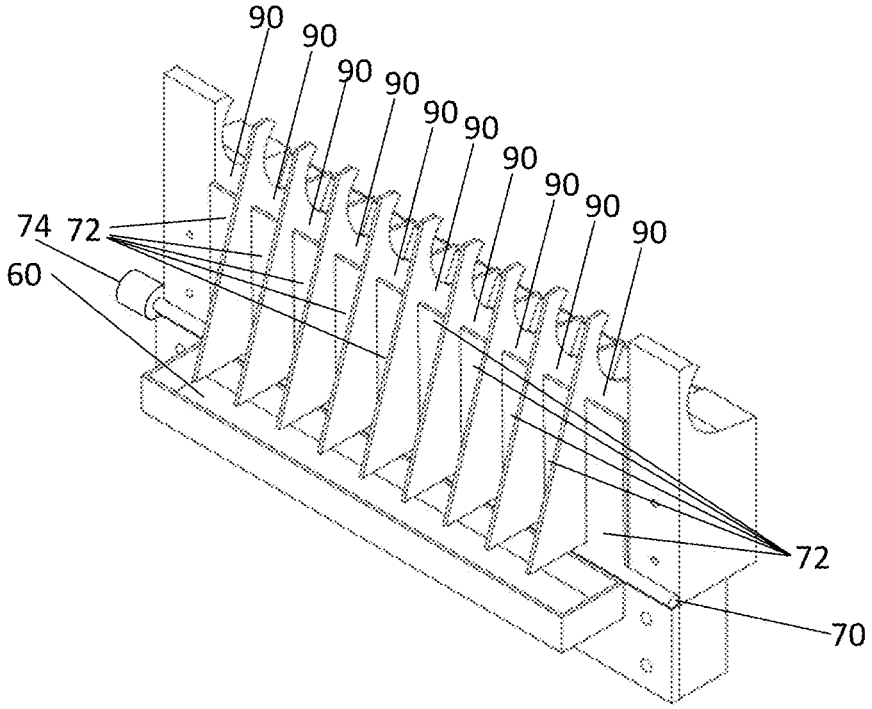
FIG. 2 is a perspective view of one embodiment of a partial view of the invention when the system directs a plurality of articles to a plurality of funnels.
Figure 3:
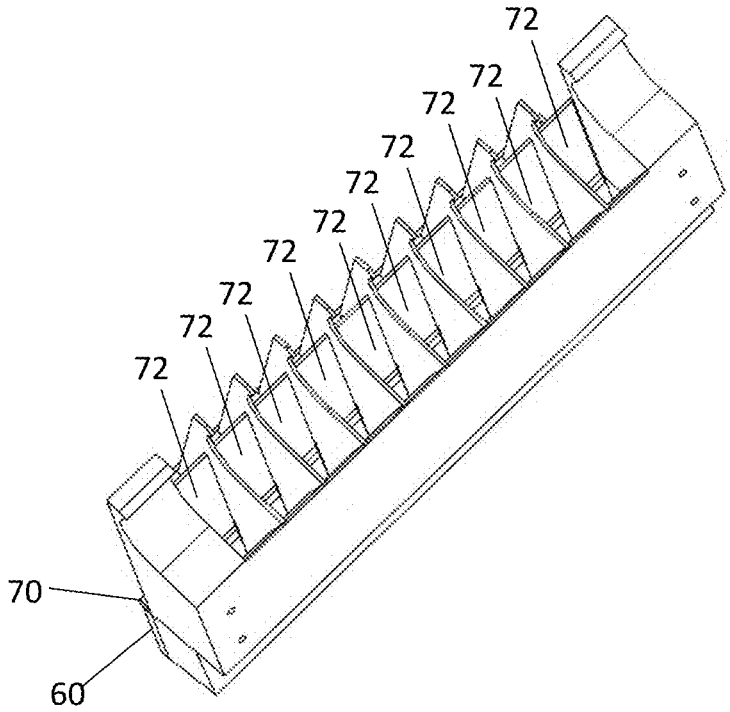
FIG. 3 is a perspective view of one embodiment of a partial view of the invention.
Figure 4:
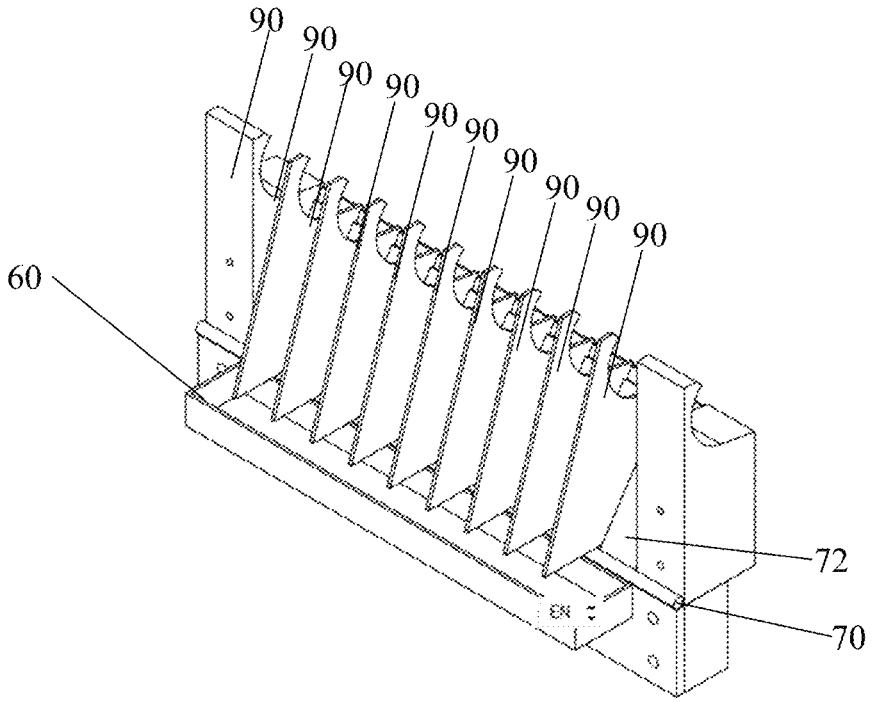
FIG. 4 is a perspective view of one embodiment of a partial view of the invention when the system ejects a bad slat.
Figure 5:
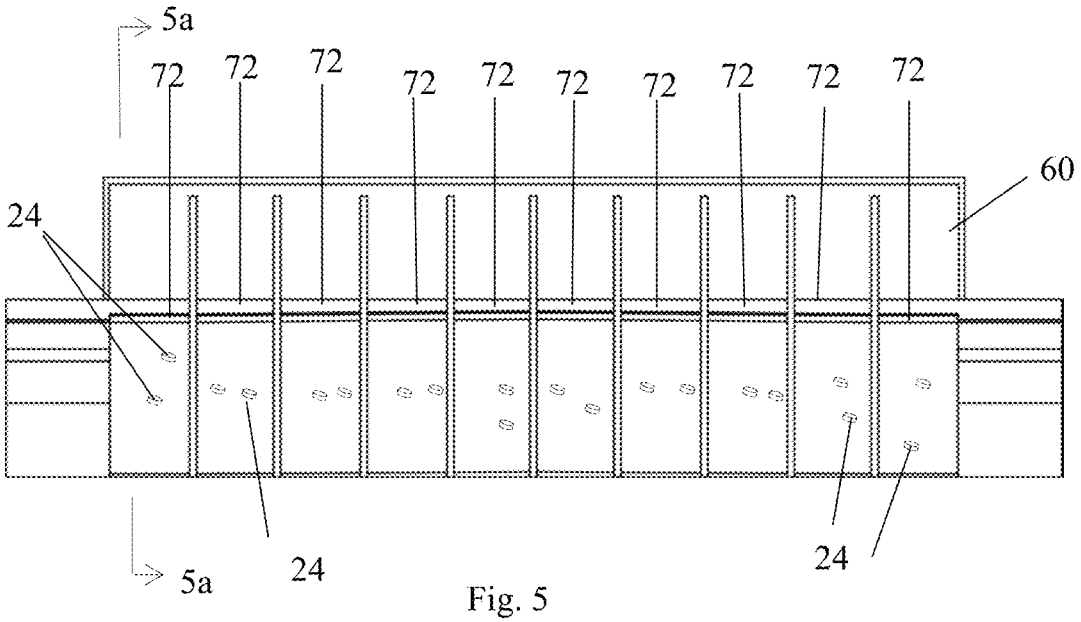
FIG. 5 is a top view of one embodiment of a partial view of the invention when the system directs a plurality of articles to the plurality of funnels.
Figure 5A:
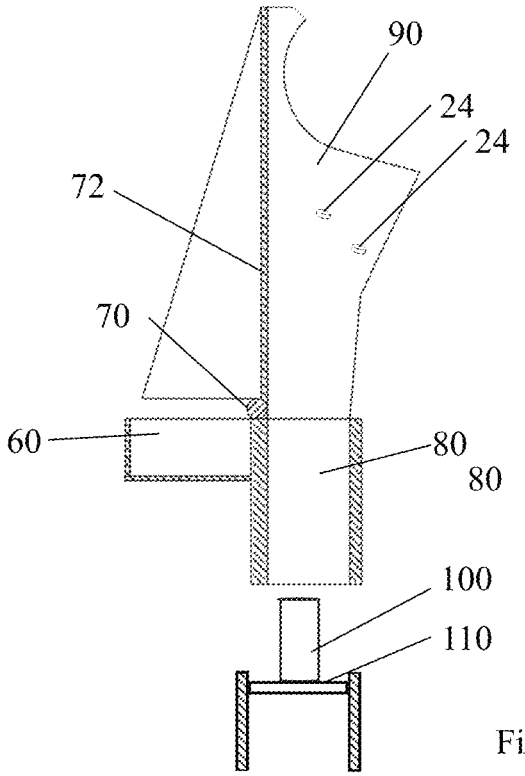
FIG. 5*a* is a sectional view of one embodiment of a partial view of the invention when the system is directing a plurality of articles to the plurality of funnels.
Figure 6:
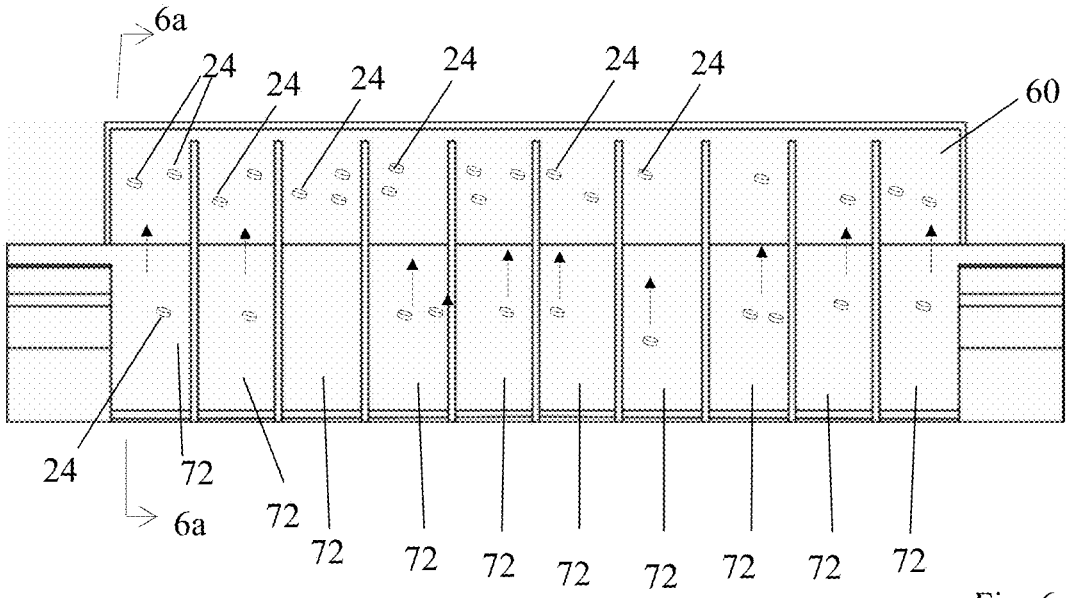
FIG. 6 is a top view of one embodiment of a partial view of the invention when the system is ejecting a bad slat.
Figure 6A:
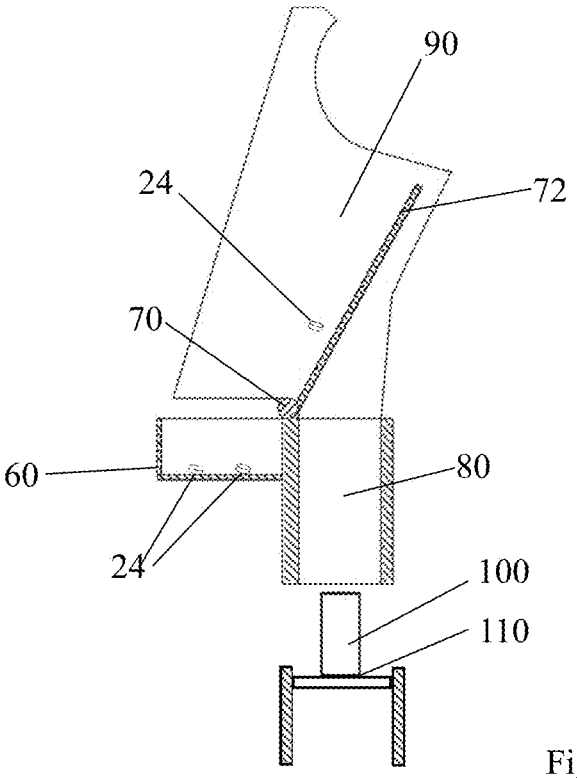
FIG. 6*a* is a sectional view of one embodiment of a partial view of the invention when the system is ejecting a bad slat.
Figure 7:
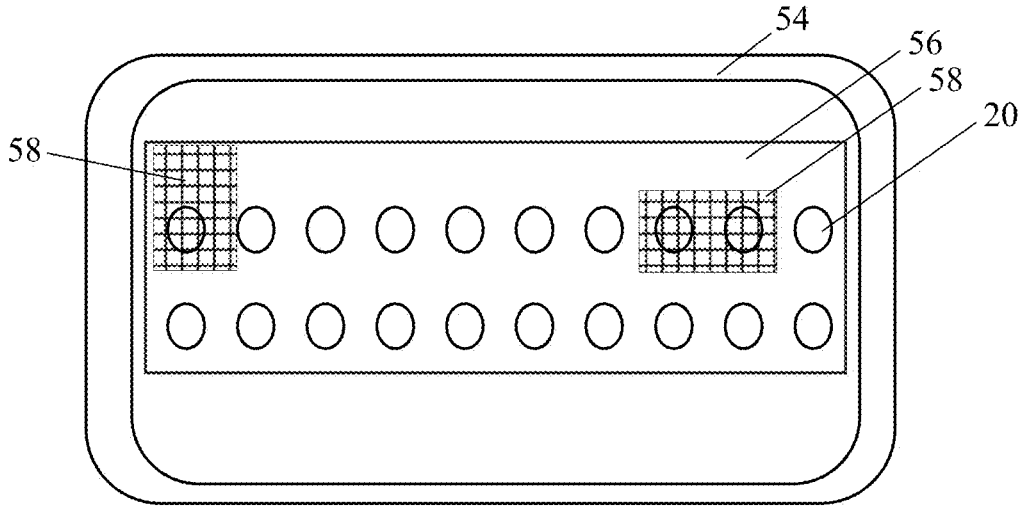
FIG. 7 is a schematic view of one embodiment of a graphic user interface.

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting, since the scope of the present invention will be limited only by the appended claims.

Referring to FIGS. 1, 5, 5*a*, 6, 6A, and 7, one embodiment of an automated slat filling system 10 for dispensing of a plurality of articles 24 to a plurality of containers 100 without rejecting one or more of the plurality of containers 100, comprises (a) a plurality of slats 20, (b) a plurality of cavities 22 formed on the plurality of the slats 20, wherein each of the plurality of articles 24 from a hopper 32 can be disposed in each of the plurality of cavities 22. (c) a conveyance device 30; wherein the conveyance device 30 is configured to move the plurality of slats 20; (d) an intelligent control device 40, wherein the intelligent control device 40 is configured to control the conveyance device 30, and wherein the intelligent control device is configured to index the plurality of slats 20; (e) a vision inspection device 50; wherein the vision inspection device 50 is configured to take an image 53 of the plurality of slats 20 by a camera 52, wherein the vision inspection device 50 is configured to take the image 53 of more than one of the plurality of slats 20, to inspect the image 53 of the plurality of slats 20 to identify a bad slat 21 from the image 53 of one of the plurality of slats 20, wherein the bad slat 21 is one of the plurality of slats 20 receives the plurality of articles 24 not meeting a predetermined criterion, wherein the vision inspection device 50 is configured to communicate with the intelligent control device 40; wherein the vision inspection device further comprises a graphic user interface 54, wherein the graphic user interface 54 is configured to set up a plurality of areas 58 of a field of view 56 of the camera 52, wherein the image 53 within the plurality of areas 58 are to be excluded from an inspection by the vision inspection device 50, (f) a rejection repository 60; and (g) a diverting device 70, wherein the diverting device 70 is configured to communicated with the intelligent control device 40, wherein the diverting device 70 is configured to divert the plurality of articles 24 on the bad slat 21 away from the plurality of containers 100 to the rejection repository 60 when the bad slat 21 is identified by the vision inspection device 50, wherein the diverting device directs the plurality of articles 24 when the bad slat 21 is not identified by the vision inspection device 50. The vision inspection device 50 is configured to process the images from 1 up to 7 of the image 53 of the one of the plurality of slats in about 130 milliseconds. However, this maximum number could be higher with the advance of computer processors in the future. The vision inspection device 50 is configured to take the image 53 of one slat or more than one slat of the plurality of slats 20 at a time. During setup of the vision inspection device, a user has access to tools via the graphic user interface that allows the user to basically draw a plurality of areas (or "masks") on the field of view of the camera. The plurality of areas where the masks are drawn are processed much quicker than the rest of the inspection areas; therefore, the total amount of time spent processing the image is reduced dramatically. There are other benefits, like dealing with dust. Some products are very dusty, and the dust would accumulate on top of the slat and interfere with the vision inspection, causing false rejects. The mask helps reduce the false reject by ignoring the area where dust would normally accumulate, but the product would not.

Referring to FIGS. 1, 2, 3, 5, 5*a*, 6, and 6A, one embodiment of an automated slat filling system 10 further comprises a plurality of gates 72 controlled by a position control device 74, wherein the position control device is configured to communicate with the intelligent control device 40, and wherein the plurality of gates 72 can be controlled by the position control device 74 to direct the plurality of articles 24 to the rejection repository 60 or to the plurality of containers 100. The plurality of articles 24 will go down the plurality of the funnels and then be directed by the plurality of gates 72 to the plurality of containers 100 when no bad slat is identified or directed to the rejection repository 60 when the bad slat is identified.

Referring to FIGS. 5, 5*a*, 6, and 6*a*, in one of the embodiments of an automated slat filling system 10, the plurality of gate 72 can be controlled by the position control device 74 to form a slope toward the rejection repository 60 and direct the plurality of articles 24 to the rejection repository 60. The plurality of gate 72 can be controlled by the position control device 74 to close the plurality of funnels 90 and form the slope toward the rejection repository 60 when the bad slat is detected by the vision inspection device 50. The plurality of containers are conveyed by a conveyance belt system 110 to a subsequence location for further process. In one embodiment of an automated slat filling system 10, no container from the plurality of containers is to be rejected. This is an innovative difference from the current filling system that fills containers with tablets or other articles first and then rejects the container that has tablets or articles less than the desired quantity or quality, which will cause a waste of the filled container that needs to be emptied and recycled back to the filling system. The automated slat filling system rejects the slat that has the plurality of articles less than the desired quantity or quality before the inferior articles being disposed into the containers. Every container of the plurality of containers from the automated slat filling system will be good and ready for the next process. Therefore, there is no need to reject the inferior containers. In one embodiment of an automated slat filling system, the position control device is a servo motor, servomotor, or servo drive. In another embodiment, the position control device can be other types of motors, such as stepper motors, direct current motors, linear motors, actuators, or a pneumatic air cylinder. In one embodiment, the position control device is selected from the group consisting of stepper motors, direct current motors, linear motors, actuators, a pneumatic air cylinder, or other type of control device known to a person of ordinary skill in the art.

A servo motor is a rotary actuator that allows for precise control of angular position. A servo motor, or a servo drive, consists of a motor coupled to a sensor for position feedback. A stepper motor, also known as a step motor or stepping motor, is an electrical motor that rotates in a series of small angular steps instead of continuously. An actuator takes a signal from a control system and moves a valve to an open or closed position. In one embodiment, the position control device is selected from the group consisting of stepper motors, direct current motors, linear motors, or actuators.

Figure 8:
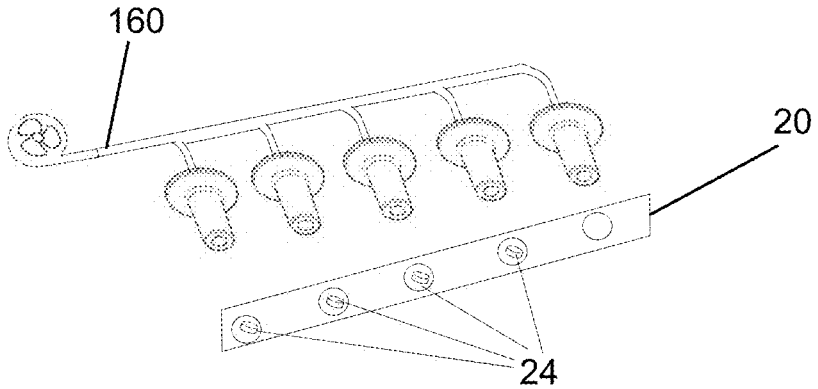
FIG. 8 is a schematic view of one embodiment of an air blowing system.

Referring to FIGS. 1 and 8, in one embodiment of the automated slat filling system 10, the automated slat filling system 10 may further comprises an air blowing system 160, wherein the air blowing system 160 is configured to communicate with the intelligent control device, and wherein the air blowing system 160 is configured to blow the plurality of articles 24 to the rejection repository or to the plurality of containers.

Figure 9:
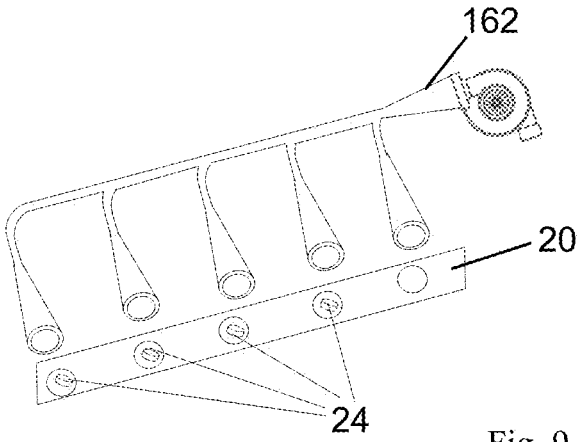
FIG. 9 is a schematic view of one embodiment of a vacuum system.
Figure 10:
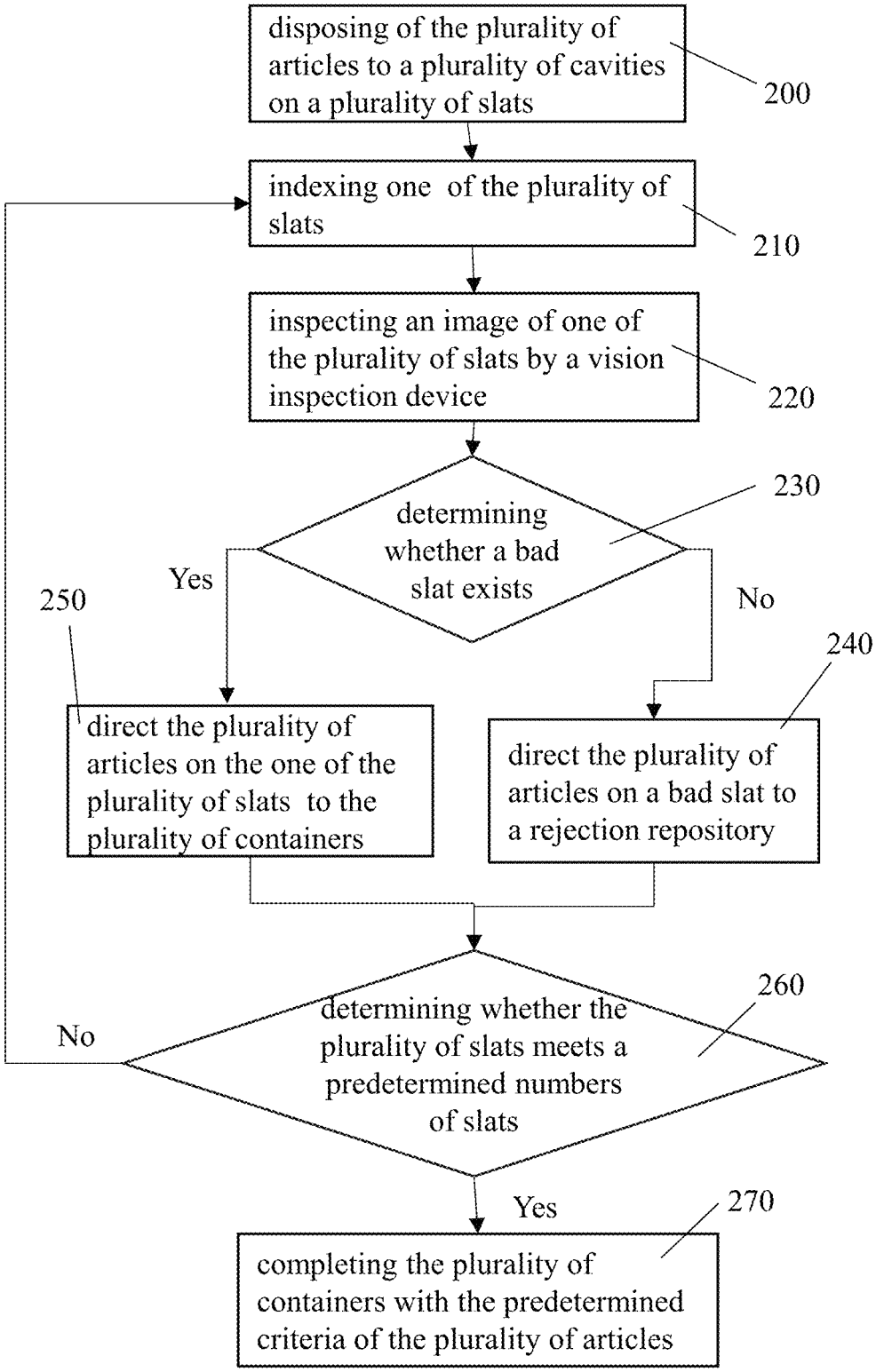
FIG. 10 is a flow chart of one embodiment of the method.
Figure 11:
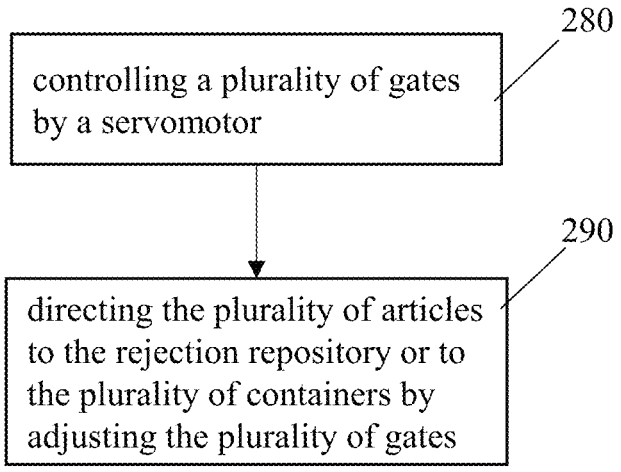
FIG. 11 is a flow chart of one embodiment of the method.
Figure 12:
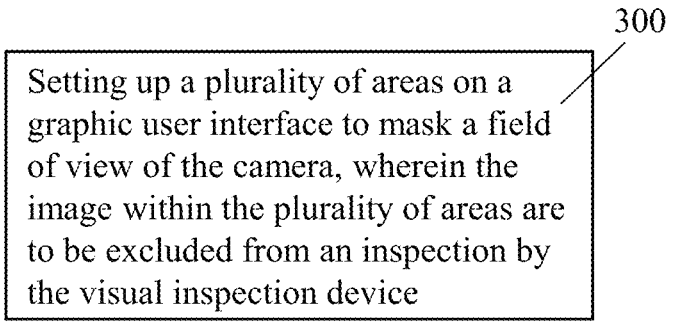
FIG. 12 is a flow chart of one embodiment of the method.

Referring to FIGS. 1 and 9, in one embodiment of the automated slat filling system 10, the automated slat filling system 10 may further comprises a vacuum system 162, wherein the vacuum system 162 is configured to communicated with the intelligent control device, wherein the vacuum system 162 is configured to evacuate the plurality of articles 24 from the plurality of slats to the rejection repository.

Referring to FIGS. 1, 2, 3, 4, 5, 6, and FIG. 8, a method of filling a plurality of containers 100 with a plurality of articles 24, comprising the steps of: disposing of the plurality of articles 24 to a plurality of cavities 22 formed on a plurality of slats 20 (step 200); indexing one of the plurality of slats 20 (step 210); inspecting an image 53 of the plurality of slats 20 taken by a vision inspection device 50 (step 220); determining whether a bad slat 21 is in the plurality of slats 20, wherein the bad slat 21 is one of the plurality of slats 20 with the plurality of articles 24 not meeting a predetermined criterion (step 230); directing the plurality of articles 24 on the bad slat 21 to a rejection repository 60 when the bad slat 21 is identified (step 240); directing the plurality of articles 24 to the plurality of containers 100 when the bad slat 21 is not identified (step 250); determining whether the numbers of the plurality of slats 20 that passes the inspection of bad slats for fulfilling the plurality of containers 100 meet a predetermined number (step 260); indexing one of the plurality of slats 20 (step 210) to make up the bad slat 21 when the plurality of slats 20 for fulfilling the plurality of containers 100 fails to meet a predetermined number; and completing the plurality of containers 100 with a predetermined criterion of the plurality of articles without a need to reject one or more of the plurality of containers 100 when the plurality of slats 20 for fulfilling the plurality of containers 100 meets a predetermined number (step 270). The plurality of containers 100 are conveyed by a conveyance belt system 110 for a subsequence process.

Referring to FIGS. 1, 7, 10, and 12, one embodiment of the method of filling a plurality of containers with a plurality of articles using an automated slat filling system 10 may further comprise step 300 of setting up a plurality of areas 58 on a graphic user interface 54 to mask a field of view 56 of the camera 52, wherein the image 53 within the plurality of areas 58 are to be excluded from an inspection by the vision inspection device 50.

Referring to FIGS. 1, 2, 3, 4, 5, 5*a*, 6, 6*a*, and FIG. 11, in one embodiment of the automated slat filling system 10, a method of filling a plurality of containers 100 with a plurality of articles 24, further comprising controlling a plurality of gates by a position control device (step 280); and directing the plurality of articles to the rejection repository or to the plurality of containers by adjusting the plurality of gates (step 290).

In one of the embodiments, the predetermined criterion for the plurality of articles to be filled into the plurality bottle can be the desired quality, such as the integrity of a tablet, the presence of the articles in a desired quantity, or both. In one of the embodiments, the plurality of gates can be in many forms, such as sliding type, pivotable type, retractable type, or any type to form or release a barrier to a funnel or a, channel or a passage. In one of the embodiments, the image 53 can be in a format of visible light or invisible light such as infrared rays, ultraviolet light, ultrasonic wave, or electromagnetic image. Also, the image 53 can be the image of one single slat or more than one of the plurality of slats. In one embodiment, the position control device is selected from the group consisting of stepper motors, direct current motors, linear motors, or actuators.

While the present disclosure has been described with reference to preferred embodiments thereof, it is to be understood that the disclosure is not limited to the preferred embodiments and constructions. The present disclosure is intended to cover various modifications and equivalent arrangements. In addition, the foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed:

1. An automated slat filling system for dispensing a plurality of articles to a plurality of containers without rejecting one or more of the plurality of containers, comprising:

(a) a plurality of slats;

(b) a plurality of cavities formed on the plurality of the slats, wherein each of the plurality of articles can be disposed in each of the plurality of cavities;

(c) a conveyance device, wherein the conveyance device is configured to move the plurality of slats;

(d) an intelligent control device, wherein the intelligent control device is configured to control the conveyance device, and wherein the intelligent control device is configured to index the plurality of slats;

(e) a vision inspection device, wherein the vision inspection device is configured to take an image of the plurality of slats by a camera, wherein the vision inspection device is configured to inspect the image of the plurality of slats to identify a bad slat from the image of one of the plurality of slats, wherein the bad slat is one of the plurality of slats receives the plurality of articles not meeting a predetermined criterion, wherein the vision inspection device is configured to communicate with the intelligent control device, wherein the vision inspection device further comprises a graphic user interface, wherein the graphic user interface is configured to set up a plurality of areas of a field of view of the camera, wherein the image within the plurality of areas are to be excluded from an inspection by the vision inspection device;

(f) a rejection repository; and (g) a diverting device, wherein the diverting device is configured to communicate with the intelligent control device, wherein the diverting device directs the plurality of articles on the bad slat away from the plurality of containers when the bad slat is identified, and wherein the diverting device directs the plurality of articles to the plurality of containers when the bad slat is not identified.

2. The automated slat filling system of claim 1, further comprising a plurality of gates controlled by a position control device, wherein the position control device is configured to communicated with the intelligent control device, and wherein the plurality of gates can be controlled by the position control device to direct the plurality of articles to the rejection repository or to the plurality of containers.

3. The automated slat filling system of claim 2, the position control device is selected from the group consisting of stepper motors, direct current motors, linear motors, actuators or a pneumatic air cylinder.

4. The automated slat filling system of claim 1, wherein the vision inspection device is configured to take the image of more than one of the plurality of slats.

5. The automated slat filling system of claim 1, wherein the vision inspection device is configured to process up to 7 of the image of the one of the plurality of slats in about 130 milliseconds.

6. The automated slat filling system of claim 1, further comprising an air blowing system, wherein the air blowing system is configured to communicate with the intelligent control device, and wherein the air blowing system is configured to blow the plurality of articles to the rejection repository or to the plurality of containers.

7. The automated slat filling system of claim 1, further comprising a vacuum system, wherein the vacuum system is configured to communicate with the intelligent control device, wherein the vacuum system is configured to evacuate the plurality of articles from the plurality of slats to the rejection repository.

8. A device for filling a plurality of containers with a plurality of articles comprising:

an automated slat filling system configured to:

dispose the plurality of articles to a plurality of cavities formed on a plurality of slats;

index one of the plurality of slats;

inspect an image of the one of the plurality of slats taken by a vision inspection device, wherein the vision inspection device further comprises a graphic user interface, wherein the graphic user interface is configured to set up a plurality of areas of a field of view of a camera of the vision inspection device, wherein the image within the plurality of areas are to be excluded from an inspection by the vision inspection device;

determine whether the one of the plurality of slats is a bad slat, wherein the bad slat is one of the plurality of slats with the plurality of articles not meeting a predetermined criterion;

direct the plurality of articles on the bad slat to a rejection repository when the bad slat is identified;

direct the plurality of articles to the plurality of containers when the bad slat is not identified;

determine whether the plurality of slats meets a predetermined number for the plurality of containers; and complete the plurality of containers with the plurality of articles meeting the predetermined criterion.

9. The device of claim 8, wherein none of the plurality of containers is rejected by the device.

10. The device of claim 8, further comprising a plurality of gates controlled by a position control device, wherein the plurality of gates are configured to direct the plurality of articles to the rejection repository or to the plurality of containers by adjusting the plurality of gates.

11. The device of claim 10, the position control device is selected from the group consisting of stepper motors, direct current motors, linear motors, actuators or a pneumatic air cylinder.

12. The device of claim 8, wherein the vision inspection device is configured to process up to 7 of the image of the one of the plurality of slats in in about 130 milliseconds.

* * * * *